US007281912B2

(12) United States Patent
Kudo

(10) Patent No.: US 7,281,912 B2
(45) Date of Patent: Oct. 16, 2007

(54) COMPRESSOR HAVING A SAFETY DEVICE BEING BUILT IN AT LEAST ONE OF THE SCREW PLUGS OF THE OIL-SEPARATOR

(75) Inventor: Takayuki Kudo, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 11/235,096

(22) Filed: Sep. 27, 2005

(65) Prior Publication Data

US 2006/0065012 A1 Mar. 30, 2006

(30) Foreign Application Priority Data

Sep. 28, 2004 (JP) ..... 2004-282083

(51) Int. Cl.
*F03C 2/00* (2006.01)
*F04C 18/00* (2006.01)

(52) U.S. Cl. ..... 418/55.6; 418/2; 418/55.1; 418/97; 418/270; 418/DIG. 1; 55/394; 55/396; 55/423; 417/13; 417/32; 417/310

(58) Field of Classification Search ..... 418/2, 418/97, 55.1–55.6, 270, DIG. 1, 57; 55/423, 55/467, 394, 396, DIG. 17; 417/13, 32, 417/310; 184/6.16–6.18
See application file for complete search history.

(56) References Cited

U.S. PATENT DOCUMENTS 1,405,259 A 1/1922 Beach
1,854,692 A 4/1932 Cooper
3,317,123 A 5/1967 Funke
3,364,658 A * 1/1968 Walker ..... 55/DIG. 17
3,499,270 A * 3/1970 Paugh ..... 55/459.1
3,684,412 A 8/1972 Harlin et al.
3,850,009 A * 11/1974 Villadsen ..... 418/97
4,332,535 A 6/1982 Terauchi et al.
4,343,599 A 8/1982 Kousokabe
4,360,321 A 11/1982 Copp, Jr. et al.
4,470,778 A 9/1984 Mabe
4,496,293 A 1/1985 Nakamura et al.
4,547,138 A 10/1985 Mabe et al.
4,666,381 A 5/1987 Butterworth
4,781,550 A 11/1988 Morishita et al.
4,842,499 A 6/1989 Nishida et al.
4,846,640 A 7/1989 Nishida et al.
4,865,530 A 9/1989 Nishida et al.
4,892,469 A 1/1990 McCullough et al.

(Continued)

FOREIGN PATENT DOCUMENTS

DE 2822780 12/1978

(Continued)

*Primary Examiner*—Theresa Trieu
(74) *Attorney, Agent, or Firm*—Baker Botts L.L.P.

(57) ABSTRACT

A compressor is provided with an oil separator for separating part of the lubricating oil contained in the compressed refrigerant, path arrangement for connecting a separation chamber of the separator and a delivery port of the compressed refrigerant, the path arrangement having a plurality of linear holes with opening ends that open in the outer surface of the housing wall, and screw plugs closing the opening ends except for the one serving as the delivery port, and a safety device built in at least one of the screw plugs, the safety device having a pressure relief valve and/or a temperature sensor.

10 Claims, 5 Drawing Sheets

U.S. PATENT DOCUMENTS

| | | | | | |
|---|---|---|---|---|---|
| 4,900,238 | A | | 2/1990 | Shigemi et al. | |
| 4,932,845 | A | | 6/1990 | Kikuchi et al. | |
| 4,936,756 | A | | 6/1990 | Shimizu et al. | |
| 4,940,396 | A | | 7/1990 | Shimizu et al. | |
| 4,958,991 | A | | 9/1990 | Kikuchi | |
| 5,271,245 | A | * | 12/1993 | Westermeyer | 62/470 |
| 5,395,224 | A | | 3/1995 | Caillat et al. | |
| 5,421,708 | A | | 6/1995 | Utter et al. | |
| 5,556,265 | A | | 9/1996 | Michiyuki et al. | |
| 5,733,107 | A | | 3/1998 | Ikeda et al. | |
| 5,800,133 | A | | 9/1998 | Ikeda et al. | |
| 6,010,320 | A | * | 1/2000 | Kwon | 418/97 |
| 6,017,205 | A | | 1/2000 | Weatherson et al. | |
| 6,074,186 | A | | 6/2000 | Lifson et al. | |
| 6,152,713 | A | * | 11/2000 | Hisanaga et al. | 418/55.6 |
| 6,227,831 | B1 | | 5/2001 | Osima et al. | |
| 6,322,339 | B1 | | 11/2001 | Mitsunaga et al. | |
| 6,454,538 | B1 | | 9/2002 | Witham et al. | |
| 6,485,535 | B1 | * | 11/2002 | Linnersten et al. | 55/319 |
| 6,511,530 | B2 | | 1/2003 | Iwanami et al. | |
| 6,755,632 | B1 | | 6/2004 | Ito et al. | |
| 7,101,160 | B2 | | 9/2006 | Gennami et al. | |
| 2001/0018025 | A1 | | 8/2001 | Sakai et al. | |
| 2002/0134101 | A1 | | 9/2002 | Gennami et al. | |
| 2005/0129536 | A1 | | 6/2005 | Ohtake | |
| 2005/0129556 | A1 | | 6/2005 | Ito | |
| 2005/0226756 | A1 | | 10/2005 | Ito | |
| 2005/0265878 | A1 | | 12/2005 | Ishida | |
| 2005/0271534 | A1 | | 12/2005 | Yokoyama | |

FOREIGN PATENT DOCUMENTS

| | | | | | |
|---|---|---|---|---|---|
| EP | 0317900 | | | 5/1989 | |
| JP | 54047110 | A | * | 4/1979 | 417/13 |
| JP | 57143187 | A | * | 9/1982 | 417/310 |
| JP | S61-205386 | | | 9/1986 | |
| JP | S63-016190 | | | 1/1988 | |
| JP | 63106393 | A | * | 5/1988 | 418/2 |
| JP | 05312167 | A | * | 11/1993 | 418/2 |
| JP | 714189 | | | 3/1995 | |
| JP | 07151083 | A | * | 6/1995 | |
| JP | 2000170681 | | | 6/2000 | |
| JP | 2000220587 | | | 8/2000 | |
| JP | 2001295767 | | | 10/2001 | |
| JP | 2003129975 | | | 5/2003 | |
| WO | 8505403 | | | 12/1985 | |
| WO | 8600369 | | | 1/1986 | |

* cited by examiner

COMPRESSOR HAVING A SAFETY DEVICE BEING BUILT IN AT LEAST ONE OF THE SCREW PLUGS OF THE OIL-SEPARATOR

BACKGROUND OF THE INVENTION

1. Field of the Invention

The present invention relates to a compressor for compressing a refrigerant in a refrigeration circuit included, for example, in an air conditioning system for a vehicle.

2. Description of the Related Art

For instance, a compressor of this type is disclosed in Unexamined Japanese Patent Publication No. 2001-295767. The compressor disclosed in this publication includes a housing and a scroll-type compression unit that is accommodated in the housing. The compression unit sucks a refrigerant introduced into the housing to compress the refrigerant, and discharges a compressed refrigerant through a discharge hole into a discharge chamber defined in the housing. A high-pressure refrigerant in the discharge chamber is delivered from a delivery port of the housing toward a condenser disposed in a refrigeration circuit.

In general, the refrigerant used in the refrigeration circuit contains lubricating oil. The lubricating oil serves for lubrication of various moving parts and sliding parts in the compressor. The lubricating oil contained in the refrigerant, however, deteriorates the refrigeration performance of the refrigeration circuit. Therefore, the compressor described in the above publication further includes an oil separator for lubricating oil. This oil separator separates part of the lubricating oil from the compressed refrigerant in the process where the compressed refrigerant is led from the discharge chamber to the delivery port of the housing. As a result, the lubricating oil content of the refrigerant that is delivered from the compressor is low, so that the refrigeration circuit can display the desired refrigeration performance.

In addition, the lubricating oil separated by the oil separator is mixed into the refrigerant in the housing and recycled for lubricating the moving parts and the sliding parts.

The oil separator includes a separation chamber located between the discharge chamber and the delivery port. The separation chamber restricts the disposition of the delivery port. In other words, the delivery port has to be disposed near the separation chamber.

A compressor of this type includes various safety devices. The compressor disclosed in Unexamined Japanese Patent Publication No. 2000-220587 has a pressure relief valve functioning as a safety device. When the pressure in the discharge chamber is abnormally raised, the pressure relief valve is opened to discharge the high-pressure refrigerant in the discharge chamber outside the compressor.

The compressor disclosed in Unexamined Japanese Utility Model Publication No. 7-14189 has a thermal protector functioning as a safety device. If the temperature in the discharge chamber is abnormally increased, the thermal protector outputs an error signal. The output of the error signal causes the driving of the compression unit to stop.

The pressure relief valve and the thermal protector are attached to respective portions of a housing wall that demarcates the discharge chamber. Consequently, the attachment of the pressure relief valve and the thermal protector requires an attachment opening and a recess to be formed in the wall of the housing. Moreover, components, such as seals and fixing screws, are indispensable.

SUMMARY OF THE INVENTION

It is an object of the present invention to provide a compressor that allows a delivery port to be disposed in an arbitrary position and allows easy attachment of a safety device, such as a pressure relief valve or a thermal protector.

The compressor of the present invention comprises a housing having a delivery port; a compression unit accommodated in the housing and securing a discharge chamber between a wall of the housing and the unit, the compression unit repeatedly carrying out a series of processes including suction of a refrigerant containing lubricating oil, compression of the sucked refrigerant and discharge of the compressed refrigerant into the discharge chamber; an oil separator for separating part of the lubricating oil from the delivered refrigerant, the separator including a separation chamber formed in the wall of the housing into which the compressed refrigerant flows from the discharge chamber; path arrangement formed in the wall of the housing, for connecting the separation chamber and the delivery port, the path arrangement including a plurality of passages that have respective opening ends opening in an outer surface of the housing, one of the opening ends serving as the discharge port, and form a delivery conduit extending from the separation chamber to the delivery port by being connected by one by one; and plug members for closing the opening ends except for the one forming the delivery port; and a safety device built in at least one of the plug members and activated according to a state of the compressed refrigerant in the path arrangement, the state indicating at least either one of pressure and temperature of the compressed refrigerant.

With the above-described compressor, the delivery port can be located in an arbitrary position according to the path arrangement connecting the delivery port and the separation chamber, that is, combination of the passages.

Since the safety device is built in the plug-member of the path arrangement, it is not necessary to form attachment openings, recesses, and the like, for the safety device in the housing. Furthermore, the attachment of the safety device itself does not require components, such as seals and screws.

This reduces processed for machining of the housing and the number of components of the entire compressor, thereby encouraging the improvement of productivity of the compressor and the reduction of production cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
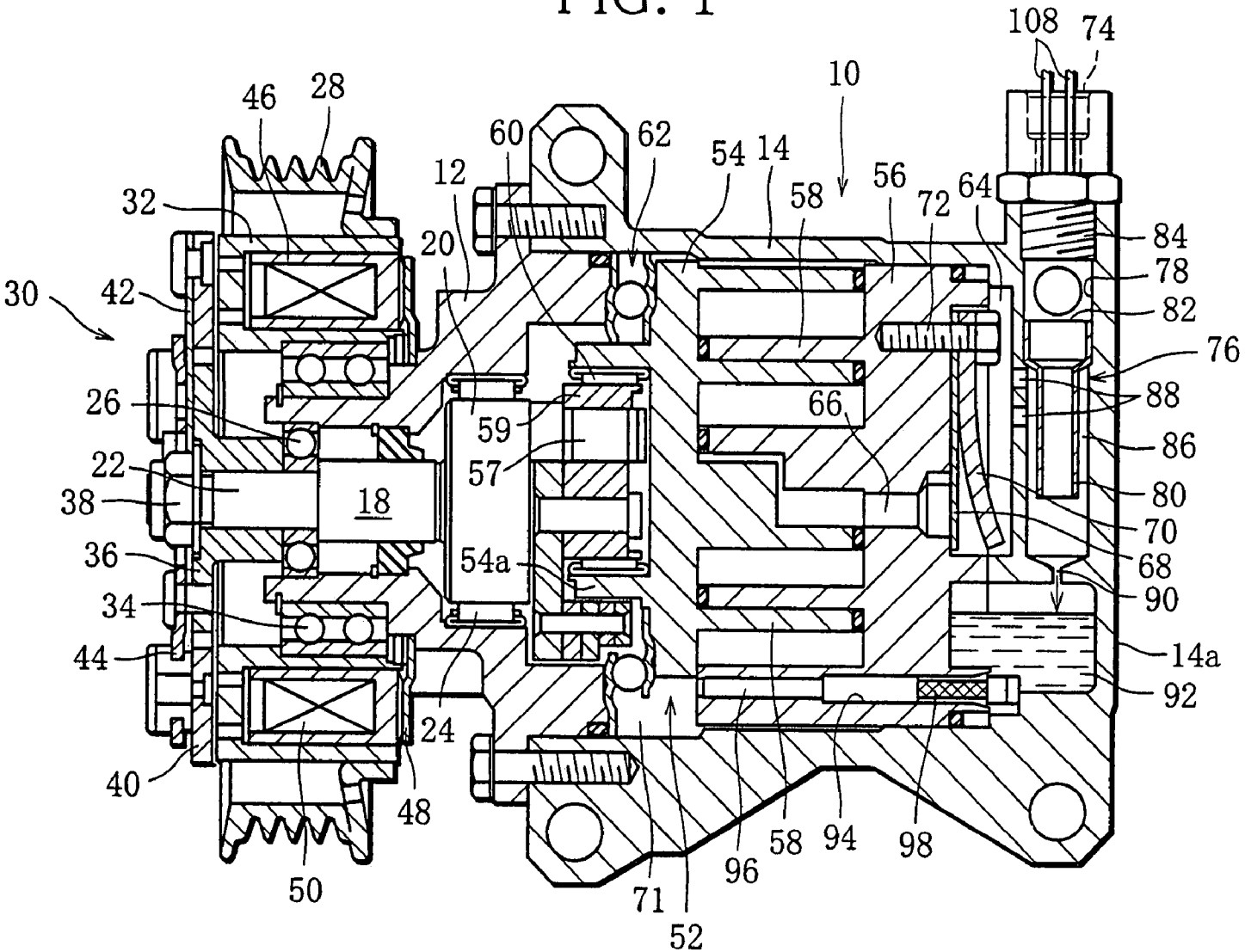
FIG. 1 is a longitudinal sectional view of a scroll-type compressor.

A scroll-type compressor shown in FIG. 1 is interposed in a refrigeration circuit of an air conditioning system for a vehicle and is used to compress a refrigerant in the refrigeration circuit. The refrigerant contains mist-like lubricating oil, which is used for lubrication of various moving parts and sliding parts disposed in the compressor.

The compressor has a cylindrical housing 10. The housing 10 is provided with a front casing 12 and a rear casing 14. The casings 12 and 14 are coupled to each other with a plurality of coupling bolts 16.

Disposed in the front casing 12 is a drive shaft 18. The drive shaft 18 has a large diameter end 20 and a small diameter end portion 22. The large diameter end 20 is positioned on the rear casing 14 side, and is rotatably supported by the front casing 12 through a roller bearing 24. The small diameter end portion 22 is rotatably supported by the front casing 12 through a ball bearing 26, and outwardly projects from the front casing 12.

The front casing 12 is surrounded with a pulley 28. The pulley 28 is attached to the front casing 12 with an electromagnetic clutch 30 interposed therebetween. More specifically, the electromagnetic clutch 30 has a rotor 32 made of a magnetic material. The rotor 32 is formed into the shape of a ring. The rotor 32 is rotatably supported by an outer circumferential surface of the front casing 12 with a ball bearing 34 interposed therebetween, and is disposed concentrically with the drive shaft 18.

The pulley 28 is mounted onto an outer circumferential surface of the rotor 32, and is capable of receiving power from a vehicle engine through a V-belt (not shown).

A metal drive disc 36 with a hub is mounted on the projecting end of the drive shaft 18. The drive disc 36 is coupled to the drive shaft 18 by using a nut 38. A ring-shaped armature 40 is disposed outside the drive disc 36 so as to face the rotor 32. The armature 40 is made of a magnetic material, and there is secured a small gap between the armature 40 and the rotor 32. The armature 40 is coupled to the drive disc 36 through leaf springs 42 and a coupling plate 44. Elastic deformation of the leaf springs 42 allows the armature 40 to move toward the rotor 32.

The rotor 32 concentrically has an annular groove. The annular groove opens toward an opposite side of the armature 40. Disposed in the annular groove of the rotor 32 is a ring-shaped stator 46. The stator 46 is made of a magnetic material, and is fastened to the front casing 12 with a ring-shaped coupling plate 48 interposed therebetween.

An electromagnetic coil 50 is accommodated in the stator 46. The electromagnetic coil 50 is fixed in the stator 46 by a filling material, such as epoxy resin, that fills a gap between an inner surface of the stator 46 and the electromagnetic coil 50.

When the electromagnetic coil 50 is supplied with electricity, that is to say, when the electromagnetic coil 50 is excited, the electromagnetic coil 50 generates an electromagnetic force. The electromagnetic force causes the armature 40 to be attracted to the rotor 32 while elastically deforming the leaf springs 42. The armature 40 is then friction-engaged with the rotor 32. As a result, rotation of the pulley 28 is transmitted through the electromagnetic clutch 30 to the drive shaft 18, so that the drive shaft 18 is rotated with the pulley 28 in one direction.

When the supply of electricity to the electromagnetic coil 50 is stopped, the electromagnetic force of the electromagnetic coil 50, namely an attractive force of the armature 40, disappears. Then, the armature 40 is detached away from the rotor 32 due to restoring force of the leaf springs 42, which breaks the friction-engagement between the armature 40 and the rotor 32. Consequently, the rotor 32 is idled with respect to the armature 40, and the transmission of the power from the pulley 28 to the drive shaft 18 is blocked.

Accommodated in the rear casing 14 is a compression unit, namely a scroll unit 52. The scroll unit 52 includes a movable scroll 54 and a fixed scroll 56. The scrolls 54 and 56 have respective spiral walls 58 engaged with each other. The spiral walls 58 form a compression chamber in cooperation with each other.

The movable scroll 54 is positioned on the front casing 12 side, and has a boss 54*a* projecting toward the front casing 12. Disposed in the boss 54*a* is a crank pin 57. The crank pin 57 extends from the large diameter end 20 of the drive shaft 18. An eccentric bush 59 is mounted on the crank pin 57. The eccentric bush 59 is rotatably supported in the boss 54*a* of the movable scroll 54 with a roller bearing 60 interposed therebetween.

A ball coupling 62 is sandwiched between an end face of the movable scroll 54 and an end wall of the front casing 12. The ball coupling 62 prevents the movable scroll 54 from rotating on its axis. Therefore, when the drive shaft 18 is rotated, the movable scroll 54 makes revolution in a state where it is prevented from rotating on its axis due to functions of the crank pin 57 and the ball coupling 62.

In the rear casing 14, there is defined a discharge chamber 64 in between an end face of the fixed scroll 56 and an end wall 14*a* of the rear casing 14. The fixed scroll 56 has a discharge hole 66 at the center thereof. The discharge hole 66 causes the discharge chamber 64 to communicate with the inside of the scroll unit 52, namely the compression chamber.

Disposed in the discharge chamber 64 is a reed valve, or a discharge valve 68, for opening/closing the discharge hole 66. The discharge valve 68 is fixed to the fixed scroll 56 together with a valve stopper 70 by using a fixing bolt 72. The valve stopper 70 restricts the opening of the discharge valve 68.

An intake (not shown) is formed in the rear casing 14. The intake is connected to an evaporator of the refrigeration circuit through a circulation path. Therefore, the refrigerant in the refrigeration circuit flows back into the rear casing 14, or a suction chamber 71, through the intake.

When the movable scroll 54 makes the revolution, the compression chamber is opened to the suction chamber 71 through an outer circumferential portion of the fixed scroll 56, thereby sucking the refrigerant from the suction chamber 71. Subsequently, the compression chamber is isolated from the suction chamber 71, and is moved toward the discharge hole 66 while reducing the volume thereof. Along with this movement, the refrigerant in the compression chamber is gradually compressed. When the compression chamber reaches the discharge hole 66, the refrigerant pressure in the compression chamber overcomes a closing force of the discharge valve 68, thereby opening the discharge valve 68. Therefore, at this point, the high-pressure refrigerant in the compression chamber is discharged through the discharge hole 66 into the discharge chamber 64. Such a process beginning from the refrigerant suction through the compression to the discharge is repeatedly performed during the revolution of the movable scroll 54.

The high-pressure refrigerant discharged into the discharge chamber 64 is delivered from the discharge chamber 64 through a delivery port 74 of the rear casing 14 to the circulation path. The circulation path supplies the high-pressure refrigerant toward the condenser of the refrigeration circuit.

An oil separator 76 is disposed between the discharge chamber 64 and the delivery port 74. The oil separator 76 and the delivery port 74 will be described below.

The oil separator 76 has a linear passage, or a cylindrical bore 78, that is formed in the inside of the end wall 14*a* of the rear casing 14. The cylindrical bore 78 extends in a vertical direction to open in an upper surface of the end wall 14*a*. Specifically, the cylindrical bore 78 has a stepped shape. An upper end portion of the cylindrical bore 78 has an internal diameter larger than a lower end portion thereof.

A separating tube 80 is inserted into the cylindrical bore 78 from the opening end of the cylindrical bore 78. The separating tube 80 includes an upper end portion that is pressed into the upper end portion of the cylindrical bore 78 and a lower end portion that extends within the lower end portion of the cylindrical bore 78. Disposed on the upper end of the separating tube 80 is a snap ring 82. The snap ring 82 prevents the separating tube 80 from coming off from the cylindrical bore 78.

After the insertion of the separating tube 80, a screw plug 84 is screwed into the upper end, or the opening end, of the cylindrical bore 78 through a seal ring (not shown). The screw plug 84 closes the opening end of the cylindrical bore 78.

The lower end portion of the cylindrical bore 78 forms a separation chamber 86. The separation chamber 86 includes an annular space between the lower end portion of the separating tube 80 and an inner circumstantial surface of the cylindrical bore 78, and a lower space positioned under the annular space. Moreover, a pair of jet holes 88 are formed in the end wall 14*a* of the rear casing 14. The jet holes 88 are separated away from each other in the vertical direction, and communicate the discharge chamber 64 to the annular space of the separation chamber 86. More specifically, the opening ends of the jet holes 88, which open into the separation chamber 86, are directed in a tangential direction of an outer circumferential surface of the separating tube 80.

The lower end of the separation chamber 86 has a tapered shape, and communicates with an oil chamber 92 through a drain hole 90. The oil chamber 92 is made up of recesses formed in the end wall of the fixed scroll 56 and the end wall 14*a* of the rear casing 14. Furthermore, there is formed a communicating passage 94 in the fixed scroll 56, and an orifice tube 96 is inserted into the communicating passage 94. The orifice tube 96 has a filter 98 disposed in an end portion on the oil chamber 92 side and an orifice (not shown).

Figure 2:
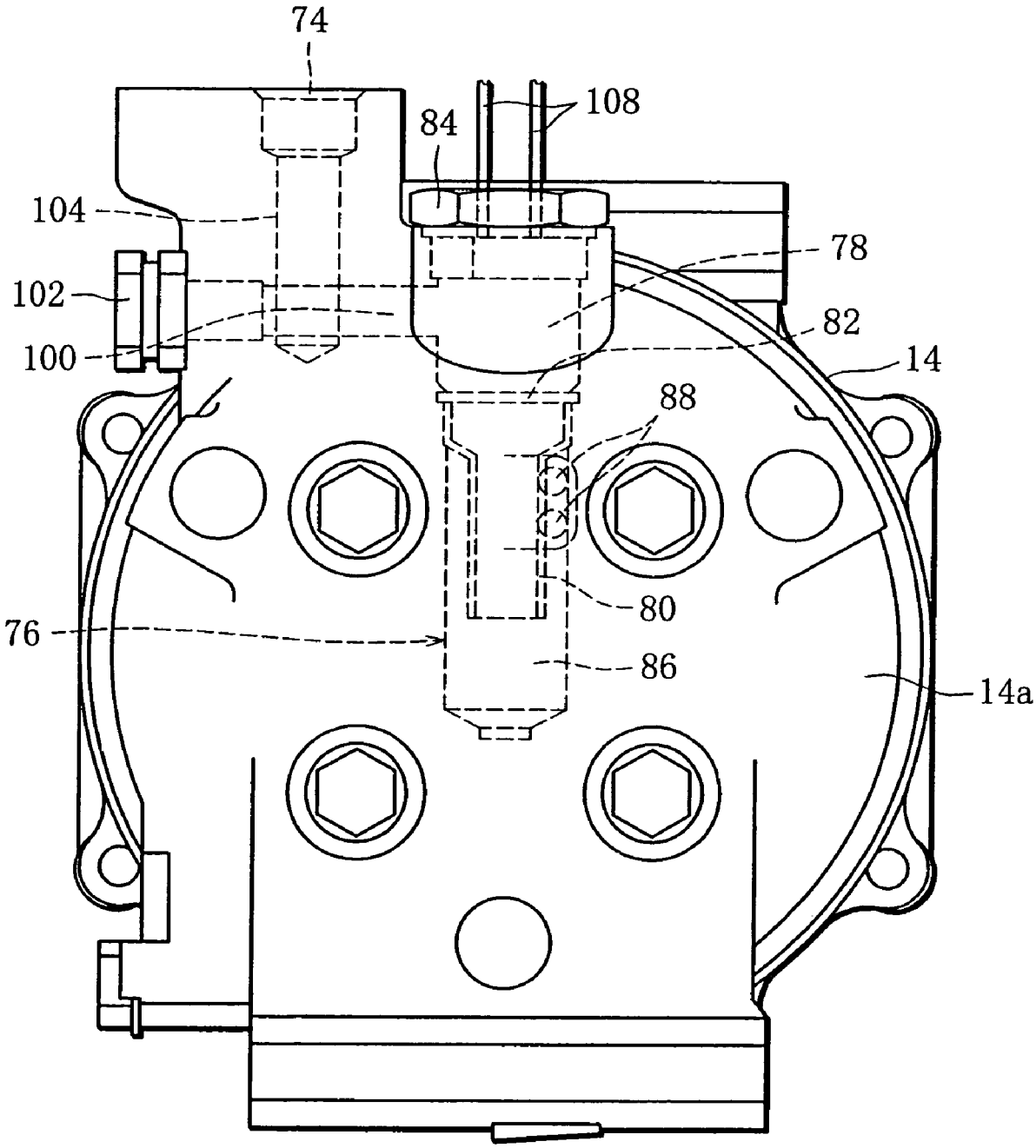
FIG. 2 is an elevation view of the compressor of FIG. 1.

A linear hole 100 horizontally extends from the upper end portion of the cylindrical bore 78. The horizontal linear hole 100 opens in a side surface of the end wall 14*a* of the rear casing 14 as is apparent from FIGS. 2 and 3. A screw plug 102 is screwed in an opening end of the horizontal linear hole 100 through a seal ring (not shown), thereby closing the opening end of the horizontal linear hole 100.

A vertical linear hole 104 extends from the middle of the horizontal linear hole 100 in an upward direction. The vertical linear hole 104 opens in the upper surface of the end wall 14*a* of the rear casing 14. An opening end of the vertical linear hole 104 forms the delivery port 74.

The horizontal linear hole 100 and the vertical linear hole 104 are machined in the rear casing 14 according to a desired position in which the delivery port 74 should be disposed. Consequently, the delivery port 74 can be disposed in an arbitrary position without being constrained by the separation chamber 86, or the cylindrical bore 78.

The oil separator 76 causes the high-pressure refrigerant in the discharge chamber 64 to flow through the jet holes 88 into the separation chamber 86. The high-pressure refrigerant flowed into the separation chamber 86 descends while swirling around the separating tube 80 along an inner circumferential wall of the separation chamber 86. At this moment, the lubricating oil contained in the high-pressure refrigerant is under centrifugal separation action. As a result, part of the lubricating oil is separated from the high-pressure refrigerant, and the separated lubricating oil is caught on the inner circumferential wall of the separation chamber 86. The high-pressure refrigerant which has undergone the centrifugal separation action flows out of the separation chamber 86 through the separating tube 80 to the upper end portion of the cylindrical bore 78, and is led from the cylindrical bore 78 to the delivery port 74 via the horizontal linear hole 100 and the vertical linear hole 104. The high-pressure refrigerant is then delivered from the delivery port 74 to the circulation path of the refrigeration circuit.

The lubricating oil separated from the high-pressure refrigerant descends along the inner circumferential wall of the separation chamber 86 due to its own weight, thereby flowing from the drain hole 90 into the oil chamber 92. Therefore, the separated lubricating oil is temporarily stored in the oil chamber 92. The lubricating oil stored in the oil chamber 92 is returned to the suction chamber 71 through the orifice tube 96 because of difference between the pressure in the oil chamber 92 and that in the suction chamber 71. In this process, the orifice tube 96 removes impurities contained in the lubricating oil by means of the filter 98 thereof, and adjusts a returning amount of the lubricating oil into the suction chamber 71 by means of the orifice thereof.

The lubricating oil returned into the suction chamber 71 is mixed into the refrigerant in the suction chamber 71, and is recycled for lubricating the various moving parts and sliding parts of the compressor.

The compressor further includes safety devices in respect of the temperature and pressure of the refrigerant. These safety devices will be described below.

Figure 3:
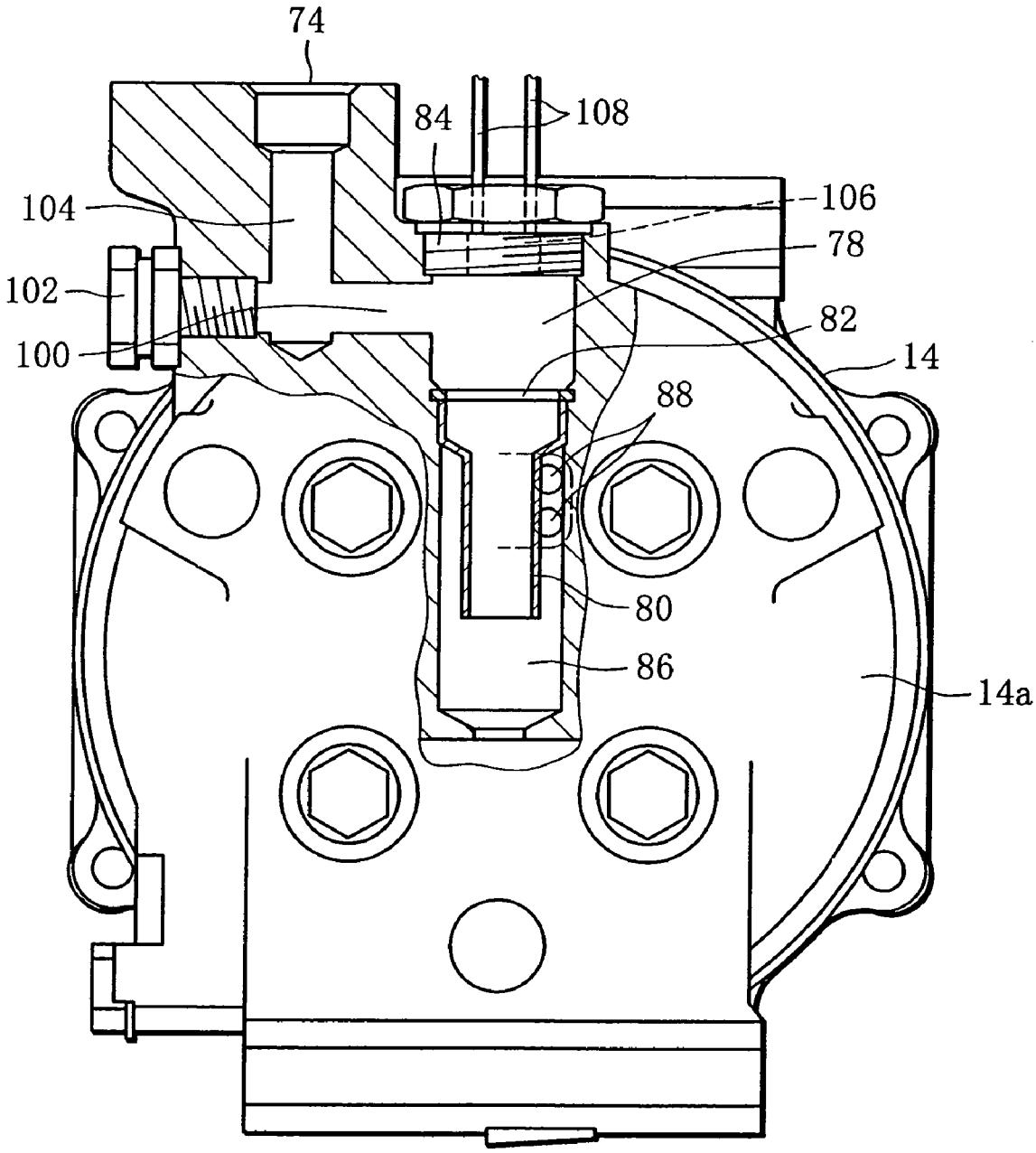
FIG. 3 is a view showing the compressor of FIG. 2, partially broken away.

As illustrated in FIG. 3, the screw plug 84 for closing the opening end of the cylindrical bore 78 is made of a metal material having an excellent thermal conductivity, and has a thermal protector, or a temperature sensor 106, serving as a safety device built-in. In the case of this embodiment, the temperature sensor 106 is a temperature switch that includes a movable contact of normally close type and a fixed contact. The movable contact is made of a temperature-sensitive member, such as bimetal. Conducting wires 108 are connected to the movable contact and the fixed contact, respectively. The conducting wires 108 extend from the screw plug 84 and form part of a power supply circuit for supplying electric power to the electromagnetic coil 50 of the electromagnetic clutch 30.

When driven at high load, the compressor occasionally raises the temperature of the compressed refrigerant to an abnormally high temperature. In the event such a state occurs, the temperature in the upper end portion of the cylindrical bore 78 is also abnormally increased. The rise of temperature opens the temperature switch 106, which opens the power supply circuit of the electromagnetic coil 50. At this point, the power supply of the electromagnetic coil 50 is stopped, and the electromagnetic clutch 30 blocks the transmission of power from the pulley 28 to the drive shaft 18, thereby stopping the driving of the compressor.

Figure 4:
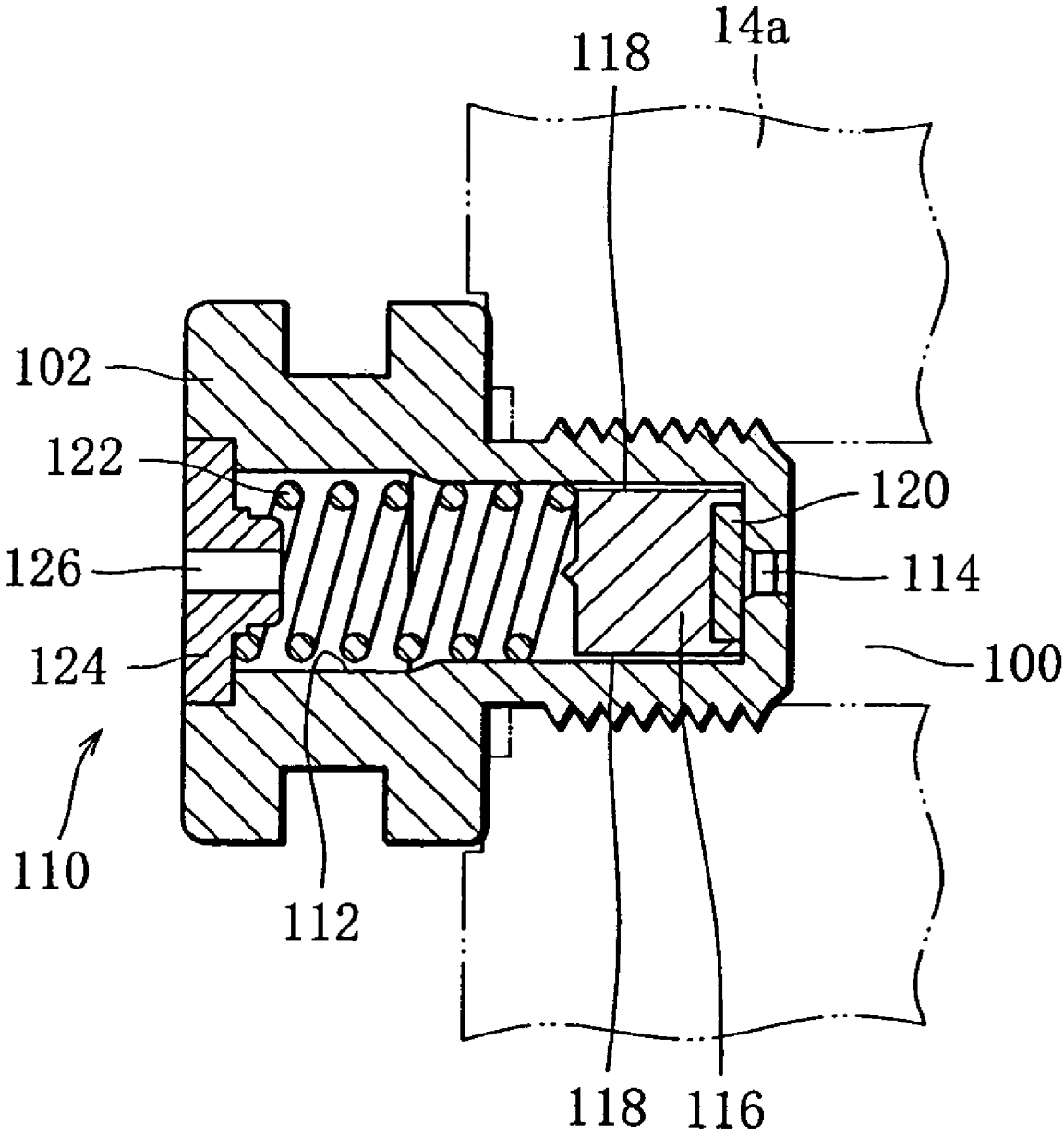
FIG. 4 is a view showing a pressure relief valve in a closed position.

The screw plug 102 for closing the opening end of the horizontal linear hole 100 has a pressure relief valve 110 serving as a safety device built-in. As illustrated in FIG. 4, the pressure relief valve 110 has a cylindrical hole 112 formed in the screw plug 102. The cylindrical hole 112 includes one end that opens in a head face of the screw plug 102 and the other end that is closed by an inner end of the screw plug 102. A valve hole 114 is formed in the inner end of the screw plug 102, thereby causing the horizontal linear hole 100 and the cylindrical hole 112 to communicate with each other.

A cylindrical valve element 116 is slidably disposed in the cylindrical hole 112. The valve element 116 has a plurality of axial grooves 118 formed in an outer circumferential surface thereof. The axial grooves 118 extend the length of the valve element 116, thereby securing a gap between the valve element 116 and an inner circumferential surface of the cylindrical hole 112. Furthermore, the valve element 116 has a seal pad 120 at one end on the valve hole 114 side.

The valve element 116 is urged by a valve spring 122 toward the valve hole 114. The valve hole 114 is closed by the seal pad 120 of the valve element 116. The valve spring 122 is a compression coil spring, and is disposed in between the valve element 116 and a spring seat 124. The spring seat 124 is formed to have the shape of a disc, and is attached to the opening end of the cylindrical hole 112. Additionally, the spring seat 124 has an exhaust hole 126 at the center thereof.

Figure 5:
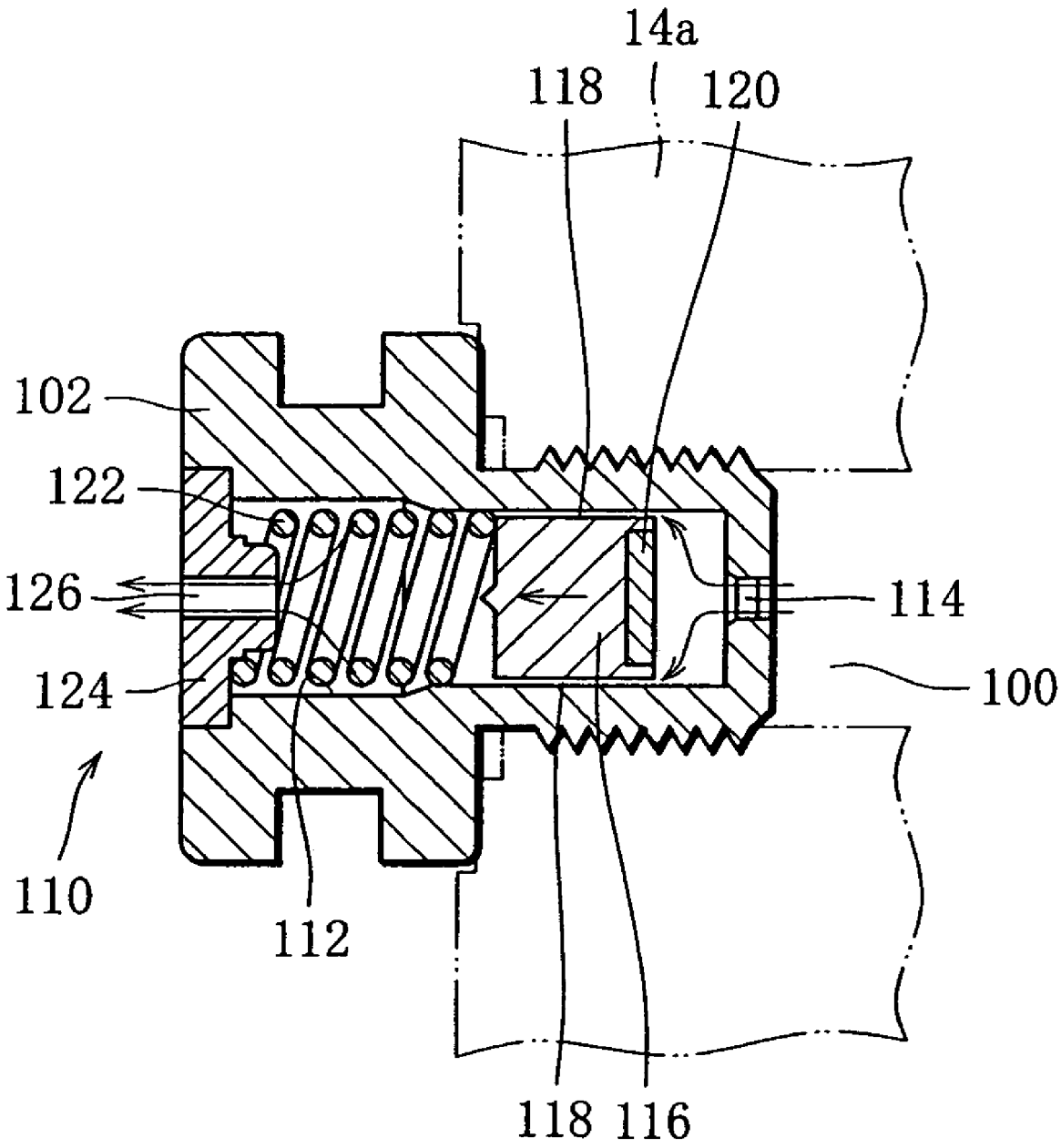
FIG. 5 is a view showing the pressure relief valve in an open position.

When driven at high load, the compressor occasionally raises the pressure of the compressed refrigerant to an abnormally high value. In the event such a state occurs, as illustrated in FIG. 5, the pressure of the compressed refrigerant in the horizontal linear hole 100 lifts the valve element 116 from the valve hole 114 against the urging force of the valve spring 122, and the seal pad 120 of the valve element 116 opens the valve hole 114. The compressed refrigerant in the horizontal linear hole 110 then passes though the pressure relief valve 110 to be exhausted outside from the exhaust hole 126. This reduces the pressure of the compressed refrigerant in a delivery conduit extending from the discharge chamber 64 to the delivery port 74.

Since the temperature sensor 106 and the pressure relief valve 110 are built in the screw plugs 84 and 102, respectively, it is not required to machine an attachment opening, a recess or the like for the sensor 106 and the valve 110 in the rear casing 14. Moreover, components, such as screws and seals, for attachment of the sensor 106 and the valve 110 are not required, either. This decreases the processes for machining with respect to the rear casing 14, and also reduces the number of components of the entire compressor.

Attachment of the temperature sensor 106 and the pressure relief valve 110 is completed at the same time with the screwing-in of the screw plugs 84 and 102, which improves the productivity of the compressor and reduces the cost for the compressor.

Furthermore, since the pressure relief valve 110 is located above the discharge chamber 64, the refrigerant liquefied in the discharge chamber 64 is not exhausted through the pressure relief valve 110, even if the pressure relief valve 110 is activated.

The present invention is not limited to the above-described one embodiment, and may be modified in various ways.

For example, both the temperature sensor 106 and the pressure relief valve 110 may be built in either one of the screw plugs 84 and 102.

The present invention may be applied to a compressor that includes either the temperature sensor 106 or the pressure relief valve 110 as a safety device. In this case, the safety device is built in either one of the screw plugs 84 and 102.

The path arrangement connecting the upper end portion of the cylindrical bore 78 and the delivery port 74 may include more linear holes than the liner holes 100 and 104. For example, the path arrangement may comprise a first linear hole connected to the separation chamber 86, a second linear hole horizontally branched from the first linear hole to open in a side surface of the wall of the housing 10, and a third linear hole upwardly branched from the second liner hole to open in the upper surface of a wall of the housing 10, in which the opening end of the third liner hole is formed as the delivery port 74.

The present invention may be applied not only to the scroll-type compressor but also to a compressor of another type, such as a swash plate compressor, as well. The compressor according to the present invention is usable not only in the refrigeration circuit of an air conditioning system for a vehicle but also in that of something else.

What is claimed is:

1. A compressor comprising:

a housing having a delivery port;

a compression unit accommodated in said housing and securing a discharge chamber between a wall of said housing and said unit, said compression unit carrying out a series of processes including suction of the refrigerant containing lubricating oil, compression of a sucked refrigerant and discharge of the compressed refrigerant into the discharge chamber;

an oil separator for separating part of the lubricating oil from the refrigerant, said separator including a separation chamber formed in the wall of said housing into which said compressed refrigerant flows from the discharge chamber;

path arrangement formed in the wall of said housing, for connecting the separation chamber and the delivery port, said path arrangement including a plurality of passages that have respective opening ends opening in an outer surface of said housing, one of the open ends serving as the delivery port, and form a delivery conduit extending from the separation chamber to the delivery port by being connected by one by one, and plug members for closing the opening ends except for the one forming the delivery port; and a safety device built in at least one of said plug members and is activated according to a state of the compressed refrigerant in said path arrangement, the state indicating at least either one of pressure and temperature of the compressed refrigerant.

2. The compressor according to claim 1, wherein:

each of the passages of said path arrangement is a linear hole that is machined in the wall of said housing.

3. The compressor according to claim 2, wherein:

said path arrangement includes a cylindrical bore extending coaxially with the separation chamber to open in an upper surface of the wall of said housing, and the cylindrical bore forms the separation chamber and a first linear hole connected to the separation chamber.

4. The compressor according to claim 3, wherein:

said path arrangement further includes a second linear hole horizontally branched from the first linear hole to open in a side surface of the wall of said housing, and a third linear hole upwardly branched from the second linear hole to open in the upper surface of the wall of the said housing, and the opening end of the third linear hole is formed as the delivery port.

5. The compressor according to claim 2, wherein:

each of said plug members is a screw plug screwed in the wall of said housing.

6. The compressor according to claim 5, wherein:

said safety device includes a pressure relief valve built in one of the screw plugs.

7. The compressor according to claim 6, wherein:

the pressure relief valve includes a valve hole formed in an inner end of the screw plug, a valve element for opening/closing the valve hole, and a valve spring for urging the valve element toward the valve hole.

8. The compressor according to claim 5, wherein:

said safety device includes a temperature sensor built in one of the screw plugs.

9. The compressor according to claim 8, wherein:

said safety device includes a pressure relief valve built in one of the screw plugs, and a temperature sensor built in another screw plug.

10. The compressor according to claim 5, wherein:

the temperature sensor is a temperature sensor having a temperature-sensitive member.

* * * * *